US005390875A

United States Patent [19]

Gietman, Jr. et al.

[11] Patent Number: 5,390,875

[45] Date of Patent: Feb. 21, 1995

[54] METHOD AND APPARATUS FOR INTERLEAVING PLASTIC BAGS

[75] Inventors: Peter J. Gietman, Jr., Combined Locks; Stephen A. Saindon, Appleton, both of Wis.

[73] Assignee: CMD Corporation, Appleton, Wis.

[21] Appl. No.: 56,528

[22] Filed: May 3, 1993

Related U.S. Application Data

[63] Continuation-in-part of Ser. No. 877,629, May 1, 1992, which is a continuation-in-part of Ser. No. 967,691, Oct. 27, 1992.

[51] Int. Cl.[6] ..... B65H 18/08; B65H 20/06

[52] U.S. Cl. ..... 242/521; 242/528; 242/535.4

[58] Field of Search ..... 242/59, 67.1 R, 67.2, 242/67.3 R, 56 R, 56 A, 521, 528, 535.4; 271/182, 183, 202, 203, 207, 213, 216, 270

[56] References Cited

U.S. PATENT DOCUMENTS

| | | | |
|---|---|---|---|
| 3,178,174 | 4/1965 | Schneider | 271/183 |
| 3,685,823 | 8/1972 | Chambon | 271/270 X |
| 4,000,864 | 1/1977 | Kurtz et al. | 242/59 |
| 4,285,513 | 8/1981 | Kwasnitza | 271/183 |
| 4,642,084 | 2/1987 | Gietman, Jr. | 493/190 |
| 4,667,890 | 5/1987 | Gietman, Jr. | 242/55 |
| 5,161,793 | 11/1992 | Lotto et al. | 271/182 |
| 5,197,727 | 3/1993 | Lotto et al. | 271/183 |

FOREIGN PATENT DOCUMENTS

| | | |
|---|---|---|
| 2210140 | 7/1974 | France . |
| 2291936 | 6/1976 | France . |
| 1949901 | 4/1971 | Germany . |
| 2011101 | 10/1971 | Germany . |
| 1326814 | 8/1973 | United Kingdom . |
| 1431350 | 4/1976 | United Kingdom . |
| 2023106 | 12/1979 | United Kingdom . |
| 2252549 | 8/1992 | United Kingdom . |

OTHER PUBLICATIONS

FMC Corporation: Advertisements, undated M-350 Winder (2 pages) M-440 Separator/Folder (2 pages) RB-840 Rotary Bag Machine (2 pages).

*Primary Examiner*—John M. Jillions
*Attorney, Agent, or Firm*—Foley & Lardner

[57] ABSTRACT

The present invention is directed to a method and apparatus for winding bags. A winder in accordance with the present invention includes a dancer assembly for speed regulation, a haul-in assembly for receiving a film, and a tumbler assembly to receive the film from the haul-in assembly. The tumbler assembly increases the path length the film travels to either separate bags and/or to provide for interleaving.

17 Claims, 6 Drawing Sheets

METHOD AND APPARATUS FOR INTERLEAVING PLASTIC BAGS

RELATED APPLICATIONS

The present application is a continuation-in-part of U.S. patent application Ser. No. 07/877,629, filed May 1, 1992, entitled "Method And Apparatus For Interleaving Plastic Bags," and U.S. patent application Ser. No. 07/967,691, filed Oct. 27, 1992, entitled "Method And Apparatus For Interleaving Plastic Bags."

FIELD OF THE INVENTION

The present invention relates generally to the art of winding equipment. More specifically, it relates to a method and apparatus for winding strips of elongate, pliable film, such as plastic bags, into either interleaved or continuous rolls. Additionally, the method and apparatus allow for selecting between winding a core or coreless roll of bags.

BACKGROUND OF THE INVENTION

Many different types of winding machines are known for winding pliable strips of material such as plastic sandwich or trash bags. The common boundary between adjacent bags is often perforated to allow for easier detachment of the bags from the roll. U.S. Pat. No. 4,667,890 (the '890 patent), incorporated herein by reference, issued to the present Applicant on May 26, 1987, describes a machine for winding coreless rolls of plastic bags. The winder described in the '890 patent winds continuous strips of bags formed from a tube of plastic which has been cross sealed and perforated. To detach a bag from the roll, contained, for example in a carton, the outermost bag is pulled and the roll turns because adjacent bags are connected. When the perforation demarking the end of the outermost bag is accessible, the outermost bag is detached, and the leading edge of the succeeding bag is presented. The film which the '890 winder winds into rolls may be received directly from a bag making machine such as one described in U.S. Pat. No. 4,642,084, incorporated herein by reference, issued to the present inventor on Feb. 10, 1987, or the perforated and sealed film may have been previously made and stored. In either case the common boundary between adjoining bags is a perforated strip to allow for detaching the bags from the roll.

Interleaved bags are also well known, i.e. bags which are wound into a roll without being connected to one another. When the outermost bag of an interleaved roll is pulled, the roll turns because of the interleaving, and the outermost bag is removed from the roll because adjacent bags are not attached to one another. Because the roll turns, the succeeding bag will be readily accessible for subsequent dispensing.

Whether continuous or interleaved, the bags may be wound about a core or they may be coreless. In some applications it is desired to have bags wound on a core such as a cardboard cylinder, to provide strength to the roll. In other cases it is desirable to have "coreless" rolls to eliminate the cost and bulk associated with the core. The '890 patent describes both a coreless winder and, in the background, a winder that produces rolls with cores.

To accommodate a wide range of applications a winder should allow the user to select either a continuous or interleaved winding mode. Also, a winder should be capable of winding core or coreless rolls. To allow for ease of use, the winder should be capable of having a continuous strip of bags as its input, regardless of the type of roll being wound. Moreover, such a method and apparatus should be precisely controllable to provide for a consistent quality product.

SUMMARY OF THE PRESENT INVENTION

A winder in accordance with the present invention includes a dancer assembly and a haul-in assembly disposed to receive the film from the dancer assembly. The haul-in assembly includes at least one haul-in roll which operates at a haul-in speed. A tumbler assembly is included and disposed to receive the film from the haul-in assembly and a winding assembly is disposed to receive the film from the tumbler assembly. The winding assembly operates at a winding assembly speed.

According to one embodiment the haul-in speed is substantially equal to the winding assembly speed and the tumbler assembly includes a tumbler which increases the path length as the last bag in each roll travels in the tumbler assembly, to separate one roll from the next roll.

According to another embodiment the haul-in assembly speed is greater than the winding assembly speed and the tumbler assembly includes a tumbler which increases the path length each bag travels. The tumbler takes up the slack caused by the speed differential and provides for interleaving bags. The tumbler may also be used to separate adjacent bags.

According to yet another embodiment, a method for winding interleaved bags from a connected strip of bags includes the steps of driving the film at a first speed in a first stage and driving the film at a second speed in a second stage that is downstream from the first stage. The second speed is less than the first speed. The path length is increased for each bag between the first and second stages, and the bags are interleaved as the path length is increased.

According to another embodiment of the foregoing method, the step of increasing the path length includes the step of separating adjacent bags.

Other principal features and advantages of the invention will become apparent to those skilled in the art upon review of the following drawings, the detailed description and the appended claims.

Figure 1:
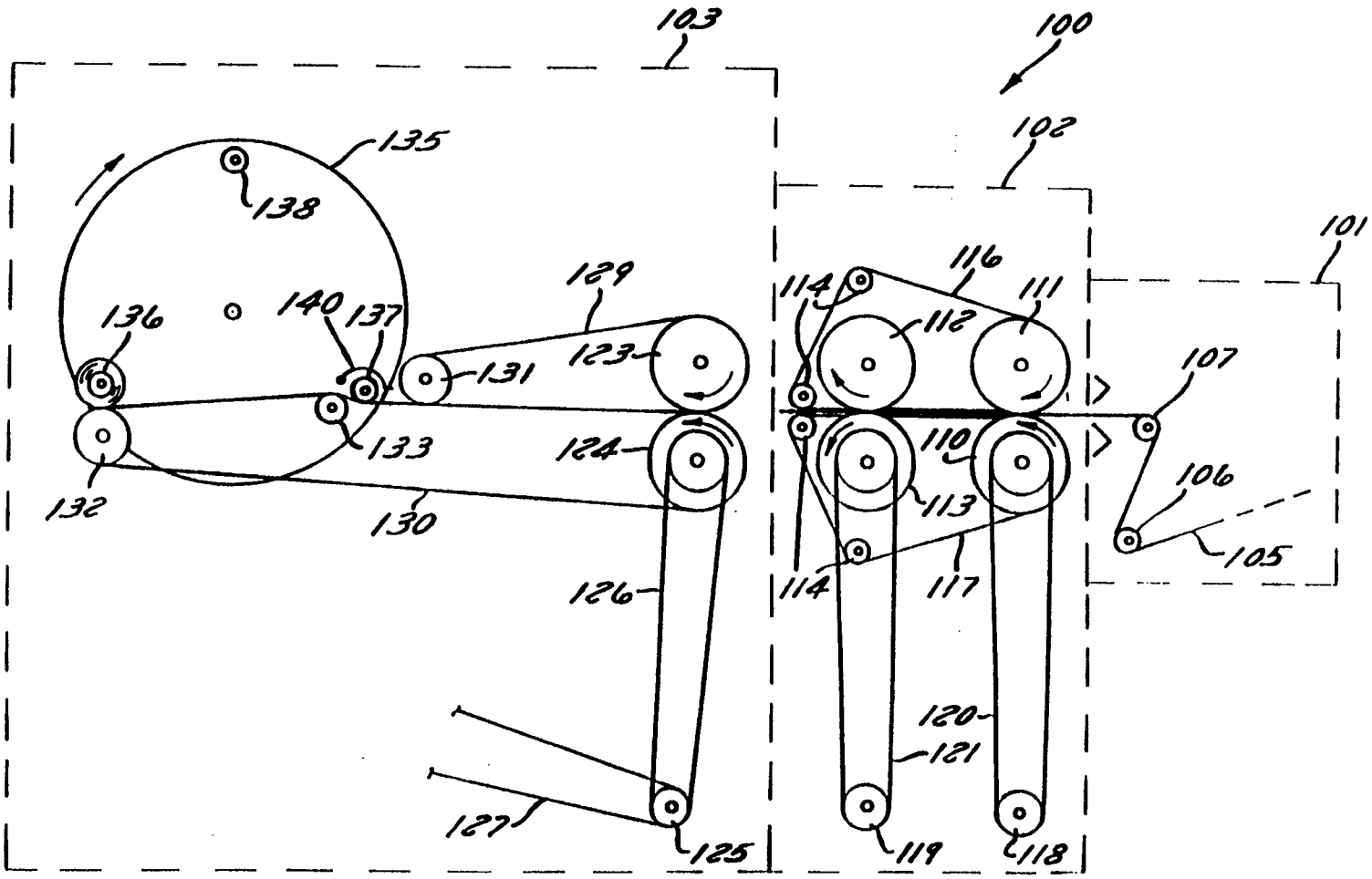
FIG. 1 PRIOR ART
FIG. 1 is a schematic representation of a prior art winder.

Before explaining at least one embodiment of the invention in detail it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting. Like reference numerals are used to indicate like components.

DETAILED DESCRIPTION OF THE PREFERRED EMBODIMENTS

The present invention will be illustrated with reference to its use as a winder for strips of plastic bags, however it should be understood at the outset that the winder may be employed for winding any pliable material. Of course, the material being wound should have sufficient tear strength to be able to withstand the winding forces imposed during the winding process. Additionally, the present invention will be disclosed with reference to a prior art winder. It should be understood that the invention is capable of being practiced with other winders as well.

Referring now to FIG. 1, a prior art winder 100 includes a dancer assembly 101, a haul-in assembly 102, and a winding assembly 103. In operation a film 105, e.g. a continuous strip of plastic bags, from either a bag making machine or a strip of previously made continuous bags, each separated by perforations is received by dancer assembly 101. Film 105 passes though dancer assembly 101 and into haul-in assembly 102, and then to winding assembly 103. As will be explained in more detail below, dancer assembly 101 is provided to regulate the speed of winder 100. Haul-in assembly 102 receives film 105 and periodically tears the perforation between the last bag of a first roll of bags and the first bag of the next roll of bags. Winding assembly 103 receives film 105 from haul-in assembly 102 and winds the film into rolls of bags, each roll having a length determined by the frequency with which haul-in assembly 102 separates bags.

Dancer assembly 101 includes a pair of dancer rolls 106 and 107. The vertical position of dancer roll 107 is responsive to the tension in film 105. Thus, the position of dancer roll 107 is also responsive to the difference in the speed of winder 100 and the speed at which film 105 is being supplied to winder 100. As will be described later, various motors drive the rolls of winder 100. Through well known techniques (described in more detail in the '890 patent) the speeds of the motors, and thus the speed of the rolls, are responsive to the position of dancer roll 107 in such a way as to take up or provide more slack in film 105, thereby "slaving" the speed of winder 100 to the incoming speed of film 105. Essentially, dancer roll 107 provides a signal dependent on the difference between the downstream and upstream film speed.

Film 105 passes from dancer assembly 101 and into haul-in assembly 102. Haul-in assembly 102 includes a pair of haul-in rolls 110 and 111, a pair of interrupt rolls 112 and 113, a plurality of guides 114, a plurality of nylon elastic ropes 116 and 117, a pair of drive motors 118 and 119 and a pair of drive belts 120 and 121. Drive motor 118 drives haul-in roll 110 by means of drive belt 120. As explained above the speed of motor 118 is slaved to the speed of film 105. Similarly, drive motor 119 drives interrupt roll 113 by means of drive belt 121. However, the speed, i.e. the linear speed at the perimeter of the roll, of interrupt roll 113 is slightly faster (typically 17% faster) than haul-in roll 110, to aid in separating one roll of bags from the next roll of bags. Nylon elastic ropes 116 are disposed about guides 114 and haul-in roll 111. Similarly, nylon elastic ropes 117 are disposed about guides 114 and haul-in roll 110. Nylon elastic ropes 116 and 117 rest in grooves in and are driven by haul-in rolls 111 and 110, respectively. Also, nylon elastic ropes 116 and 117 are disposed in grooves in interrupt rolls 113 and 112, respectively, that are large enough to prevent ropes 116 and 117 from slowing down interrupt rolls 112 and 113.

In operation haul-in rolls 110 and 111 are closed, forming a nip therebetween. When initially threading film 105, film 105 is engaged by the nip between haul-in rolls 110 and 111, and passes therebetween. Film 105 is thereafter guided by nylon elastic ropes 116 and 117 past interrupt rolls 112 and 113, which are normally open, i.e. no nip formed between them. Interrupt rolls 112 and 113 are provided to separate one strip forming a first roll from the succeeding strip of bags. As described above normally-open interrupt rolls 112 and 113 are driven at a faster rate of speed than haul-in rolls 110 and 111. At the time when the perforation following the last bag in a roll of bags is between haul-in rolls 110/111 and interrupt rolls 112/113, interrupt rolls 112 and 113 are brought together to form a nip. The nip between interrupt rolls 112 and 113 engages film 105 and, because of the higher speed of interrupt rolls 112 and 113, pulls the film away from the nip between haul-in rolls 110 and 111, causing the film to tear at the perforation between interrupt rolls 112/113 and haul-in rolls 110/111, thus accomplishing the desired separation. A counter (not shown) is provided to determine when the desired number of bags have passed haul-in rolls 110 and 111, and thus when the selected perforation is between interrupt rolls 112/113 and haul-in rolls 110/111.

After leaving haul-in assembly 102 film 105 passes into winding assembly 103. Winding assembly 103 includes a pair of conveyor rolls 123 and 124, a drive motor 125, a pair of drive belts 126 and 127, a plurality of nylon elastic ropes 129, a conveyor belt 130, a plurality of rolls 131–133, a turret 135 having a plurality of rotating spindles 136–138 mounted thereon, and an air horn 140. Drive motor 125, whose speed is controlled by the position of dancer roll 107, drives conveyor roll 124 by means of drive belt 126. Also, drive motor 125 drives turret 135 and spindles 136–138 by means of drive belt 127 (and other drive mechanisms which are not shown). Conveyor belt 130 is disposed in grooves in conveyor roll 124 and rolls 132 and 133 and serves to guide film 105 to the spindles for winding. Nylon elastic ropes 129 are disposed in grooves in conveyor roll 123 and roll 131 and serve to guide film 105 to the spindles for winding. Airhorn 140 cooperates with the spindle in the position that spindle 137 is in to initiate winding film 105 about the spindle.

In operation, film 105 passes through a nip formed between conveyor rolls 123 and 124, and is guided by nylon elastic ropes 129 and conveyor belt 130 to turret 135. As described in the '890 in detail, air horn 140 cooperates with turret 135 and spindles 136–138 to wind the leading edge of a strip of bags into a nip formed between the bag and spindle 137. After the leading edge of the roll of bags has thus been secured to spindle 137, turret 135 is rotated so that spindle 137 is in the position occupied by spindle 136 in FIG. 1. The winding of the strip into the roll of bags continues at that position until the tail of the roll of bags is completely wound. The leading edge of the next roll of bags has then been wound about the spindle near air horn 140. After the next roll of bags is "started" the turret rotates again. The spindle having the completely wound roll of bags rotates to the top position, where a push off palm (not shown) removes the roll of bags from the spindle. The spindles are provided with air holes (described in detail in the '890 patent) to facilitate removal of the rolls of bags.

Figure 2:
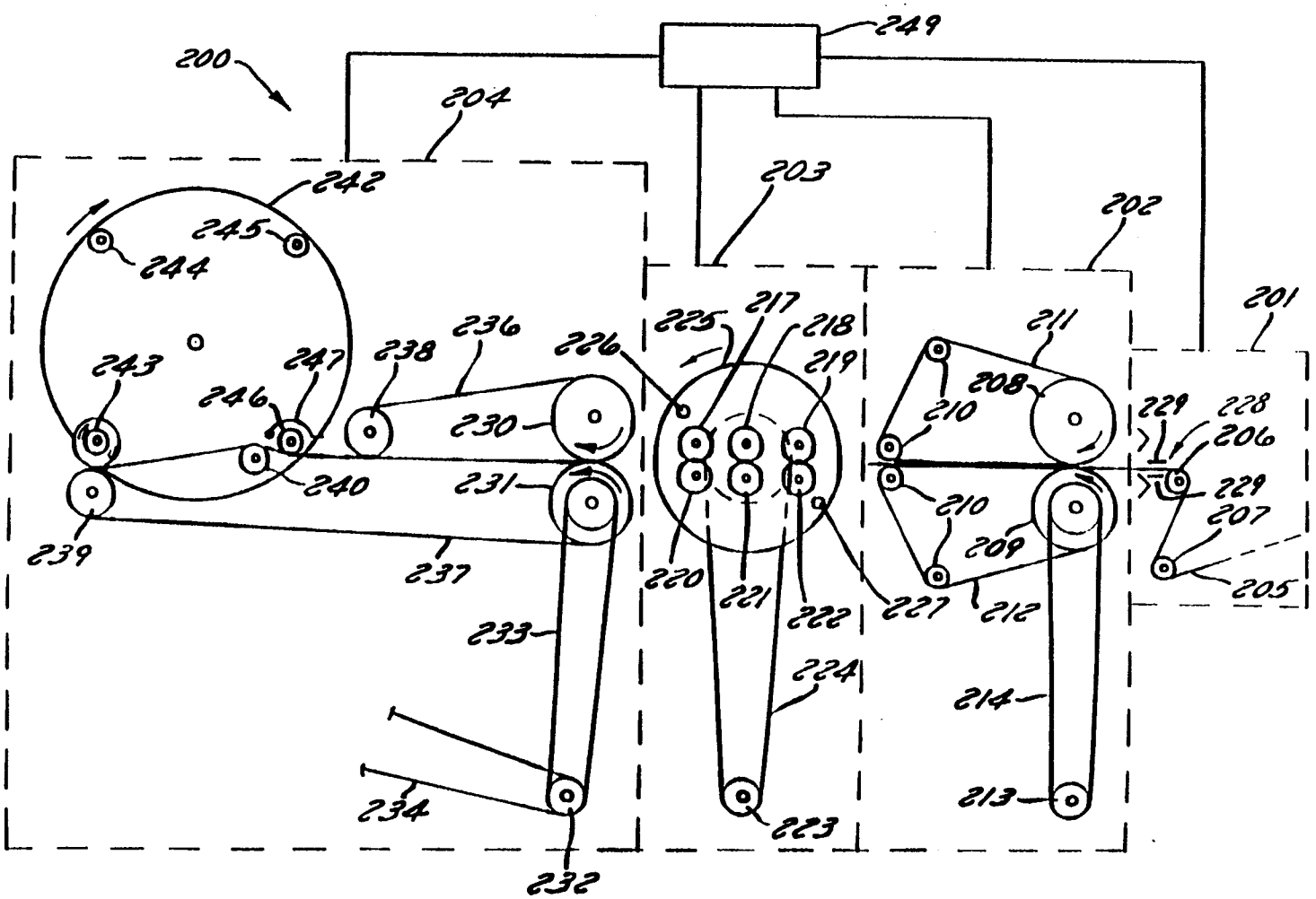
FIG. 2 is a schematic representation of a winder constructed in accordance with the present invention.

Referring now to FIG. 2, a winder 200 constructed in accordance with the present invention may be operated in either a continuous or interleaving mode, and includes a dancer assembly 201, a haul-in assembly 202, a tumbler assembly 203 and a winding assembly 204. In operation a strip of film 205, suitably made of plastic or another pliable material (which may be provided either directly from a bag making machine or from a premade roll of bags) passes through dancer assembly 201 to haul-in assembly 202. From haul-in assembly 202 film 205 is provided to tumbler assembly 203 and then to winding assembly 204. To more readily understand its operation, the continuous mode of operation will be described first.

As in the prior art, dancer assembly 201 is used to adjust the speed of winder 200. Dancer assembly 201 includes a pair of dancer rolls 206 and 207. The speed of winder 200 is regulated according to the amount of slack in film 205, as determined by the position of dancer roll 206, through a micro-processor 249 which controls various servo-drive motors (described later).

A spark gap counter 228 is provided to detect the end of one bag and the beginning of the next. Two electrodes 229 (one of which may be a back plane) are provided and film 105 passes between them. A voltage high enough to create an arc across electrodes 229 when no film is between the electrodes, but not high enough to create an arc when a film is between the electrodes, is applied across electrodes 229. Thus, as film 105 passes between electrodes 229 there is no arc, but when the perforation passes between electrodes 229 an arc is created. To insure that a perforation passes between electrodes 229 two pairs of electrodes offset by one-half the distance between adjacent holes in a perforation may be used. A simple discharge sensing circuit is provided which detects when the arc is created, and signals the start of a new bag. Spark gap counter 228 should be positioned so that the distance from it to tumbler assembly 203 is constant (i.e. downstream of dancer roll 206).

Film 205 leaves dancer assembly 201 and enters haul-in assembly 202 which includes a pair of haul-in rolls 208 and 209, a plurality of guides 210, a plurality of nylon elastic ropes 211 and 212, a servo motor drive 213 and a drive belt 214. Servo drive motor 213 drives haul-in roll 209 by means of drive belt 214. While other types of motors may be used, in the preferred embodiment, motor 213 is a servo drive motor to effect better control of speed, but it could be a standard AC motor. As in the prior art, the speed of servo motor drive 213 is slaved to the speed of film 205. Nylon elastic ropes 211 are disposed in grooves in haul-in roll 208 and upper guides 210 and serve to guide film 205 to tumbler assembly 203. Similarly, nylon elastic ropes 212 are disposed in grooves in haul-in roll 209 and lower guides 210.

In operation haul-in rolls 208 and 209 are closed, forming a nip therebetween. When initially threading film 205, film 205 is "grabbed" by haul-in rolls 208 and 209, and passes therebetween. Film 205 is thereafter guided by nylon elastic ropes 211 and 212 out of haul-in assembly 202. In accordance with the preferred embodiment it is not necessary to include the prior art interrupt rolls in haul-in assembly 202 because, as will be explained below, the separating of bags may be done in tumbler assembly 203. However, while not necessary, the interrupt rolls could be included. After leaving haul-in assembly 202, film 205 is received by tumbler assembly 203.

Figure 6:
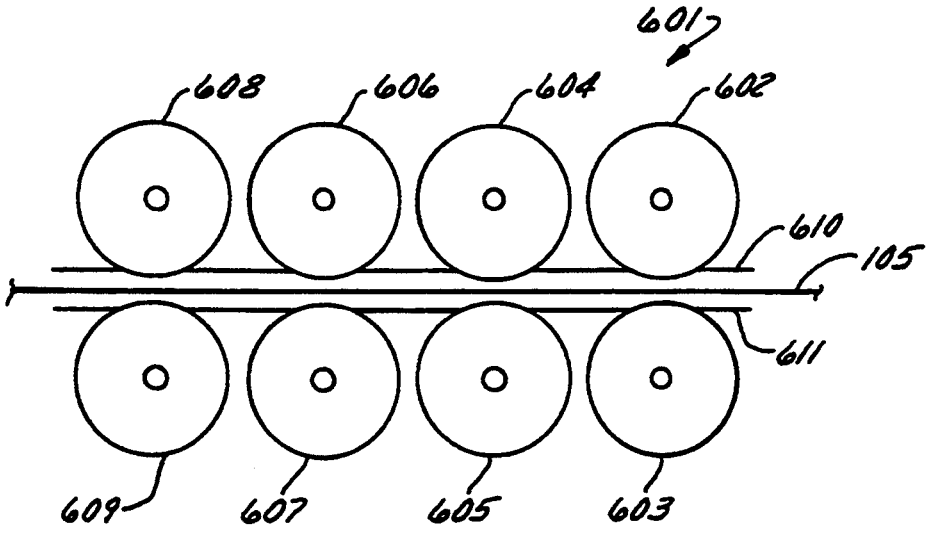
FIG. 6 is the schematic representation of an alternative embodiment of the haul in assembly of the winder of FIG. 2.

An alternative embodiment of haul in assembly 202 is shown in FIG. 6, referred to as 601, and includes 8 rolls (4 pair) 602–609. Unlike rolls 208 and 209, rolls 602–609 turn at a speed slightly faster than the film speed and are provided with an open nip to avoid having a pinch point for film 105. Also, because rolls 602–609 rotate at a speed greater than the film speed film 105 effectively rides on air. This may reduce the likelihood of flyback or folding back of film 105. There are 4 each of fingers 610 and 611 disposed in grooves in rolls 602–609 to help guide film 105 to tumbler assembly 203.

Figure 3:
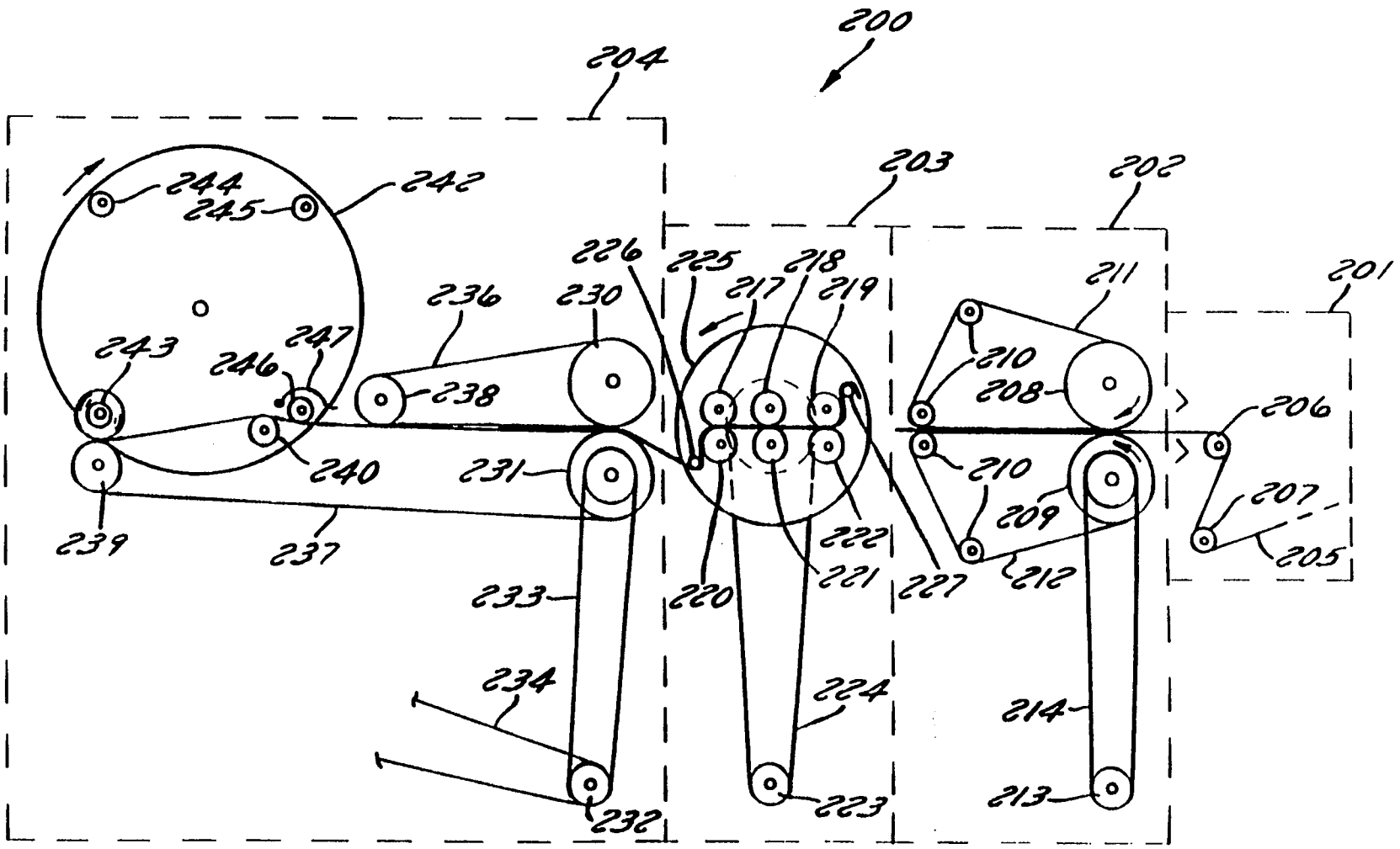
FIG. 3 is a schematic representation of the winder of FIG. 2 with the tumbler in a second position.

Tumbler assembly 203 includes a plurality of rolls 217–222, a servo motor drive 223, a drive belt 224, a tumbler 225 having a pair of spools 226 and 227 mounted thereon. In the continuous mode tumbler 225 rests in the position shown in FIG. 2, except when separating a trailing bag in one roll from the leading bag of the next roll. To tear these two bags apart tumbler 225 is quickly incremented counterclockwise to the position shown in FIG. 3 when the perforation to be torn is between tumbler 225 and haul-in rolls 208 and 209. In an alternative arrangement the rotation is clockwise. Spools 226 and 227 in turn cause the path of the film that has not yet passed out of tumbler assembly 203 to lengthen and the perforation to tear (see FIG. 3). The tumbler 225 then rotates forward to its starting position. Servo motor drive 223 increments tumbler 225 at the proper time in accordance with spark gap counter 228, or other suitable counting technique. The use of spark gap counter 228 allows servo motor drive 223 to precisely separate adjacent bags. Rolls 217–222 rotate at a speed slightly greater than the film speed (at the same as rolls 602–609 ) and are provided to guide the leading edge of each roll of bags through tumbler assembly 203. Rolls 217–222 do not rotate with tumbler 225, but rotate about their own axes.

After leaving tumbler assembly 203 film 205 passes into winding assembly 204. Winding assembly 204 includes a pair of conveyor rolls 230 and 231, a drive motor 232, a pair of drive belts 233 and 234, a plurality of nylon elastic ropes 236, a conveyor belt 237, a plurality of rolls 238–240, a turret 242 having a plurality of rotating spindles 243–246 mounted thereon, and an air horn 247. Drive motor 232, whose speed is controlled by the position of dancer roll 107, drives conveyor roll 231 by means of drive belt 233. Also, drive motor 232 drives turret 242 and spindles 243–246 by means of drive belt 234 (and other drive mechanisms which are not shown). Conveyor belt 237 has V belts on its bottom which are disposed in grooves in conveyor roll 231 and rolls 239–240 and serves to convey film 205 to spindles 243–246 for winding. Nylon elastic ropes 236 are disposed in grooves in conveyor roll 230 and roll 238 and serve to guide film 205 to the spindles 243–246 for winding. Airhorn 247 cooperates with the spindle in the position that spindle 246 is in to begin wrapping the film about the spindle.

In operation film 205 passes through a nip formed between conveyor rolls 230 and 231, and is guided by conveyor belt 237 and nylon elastic ropes 236 to turret 242. Air horn mechanism 247 cooperates with turret 242 and spindles 243–246 to wind the leading edge of a roll of bags into a nip formed between itself and spindle 246. After the leading edge of the strip of bags has thus been secured to spindle 246, turret 242 is rotated so that spindle 246 moves to the position that spindle 243 is in. The winding of the film 205 into a roll of bags continues in this position until the tail of the roll of bags is wound. The leading edge of the next roll of bags has then been wound about the spindle near air horn 247 and the turret rotates again. The spindle having the completely wound roll of bags rotates to the next position, where a push off palm (not shown) removes the roll of bags from the spindle. For winding coreless rolls the number of spindles could be three, as shown in the prior art and the spindles are provided with air holes to facilitate removal of the roll of bags. Of course, more than four spindles could also be used.

In the interleave mode of operation winder 200 operates as above with two changes. First, because interleaving effectively "shortens" the length of the film, winding assembly 204 operates at a slower speed than haul-in assembly 202. Second, tumbler assembly 203 (or some other mechanism such as interrupt rolls) must detach each bag from the succeeding bag. Also, tumbler 225 takes up the slack created by the speed differential between haul-in assembly 202 and winding assembly 204.

Tumbler 225 is in the position shown in FIG. 2 when the leading edge of film 205 is received by tumbler assembly 203. The leading edge passes between rolls 217–222 which serve to guide film 205 through tumbler assembly 203. The leading edge of film 205 is then received by winding assembly 204. After the leading edge of film 205 has been received by conveyor rolls 230 and 231 tumbler 225 is rotated or incremented by servo motor drive 223 to the position shown in FIG. 3. This rotation is a sharp step or incrementation, and spools 226 and 227 abruptly lengthen the path of the film between conveyor rolls 230–231 and haul-in rolls 208–209, tearing the perforation between the bags, as shown by the broken line in film 205 in FIG. 3. Thus, it may be seen that tumbler 225 separates adjacent bags. Tumbler assembly 203 also takes up the slack created by interleaving bags, as will be described below.

Winding assembly 204 operates in a manner similar to that of the prior art, except at a slower speed to accommodate the interleaving of bags. As bag 205A proceeds through winding assembly, tumbler 225 rotates to the position shown in FIG. 4, thus spools 226 and 227 take up the slack created by the more slowly moving conveyor rolls 230 and 231. The leading edge of the succeeding bag 205B enters tumbler assembly 203, while tumbler 225 is rotating. Succeeding bag 205B passes between rolls 217–222, which do not rotate with tumbler 225.

Figure 4:
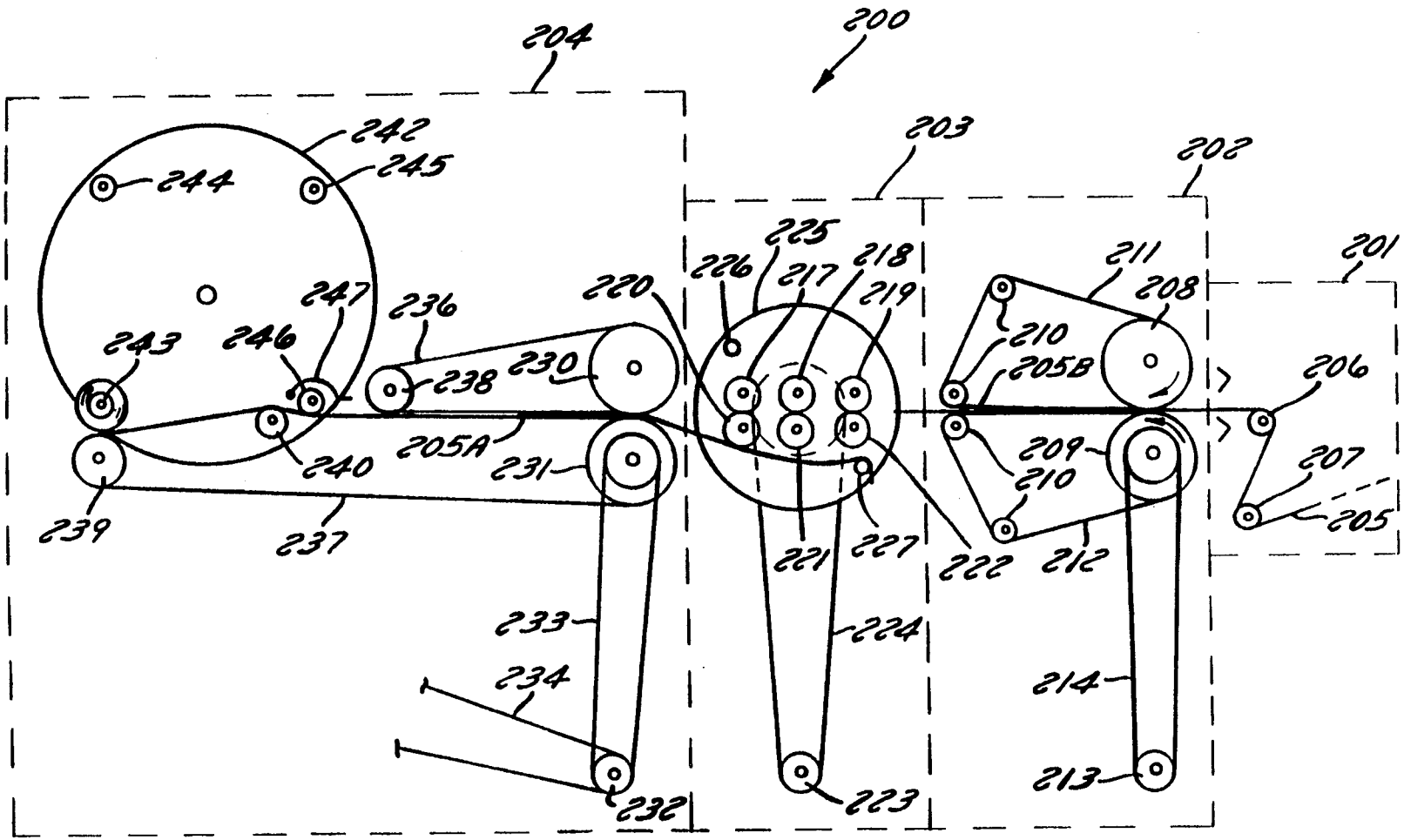
FIG. 4 is a schematic representation of the winder of FIG. 2 with the tumbler in a third position.
Figure 5:
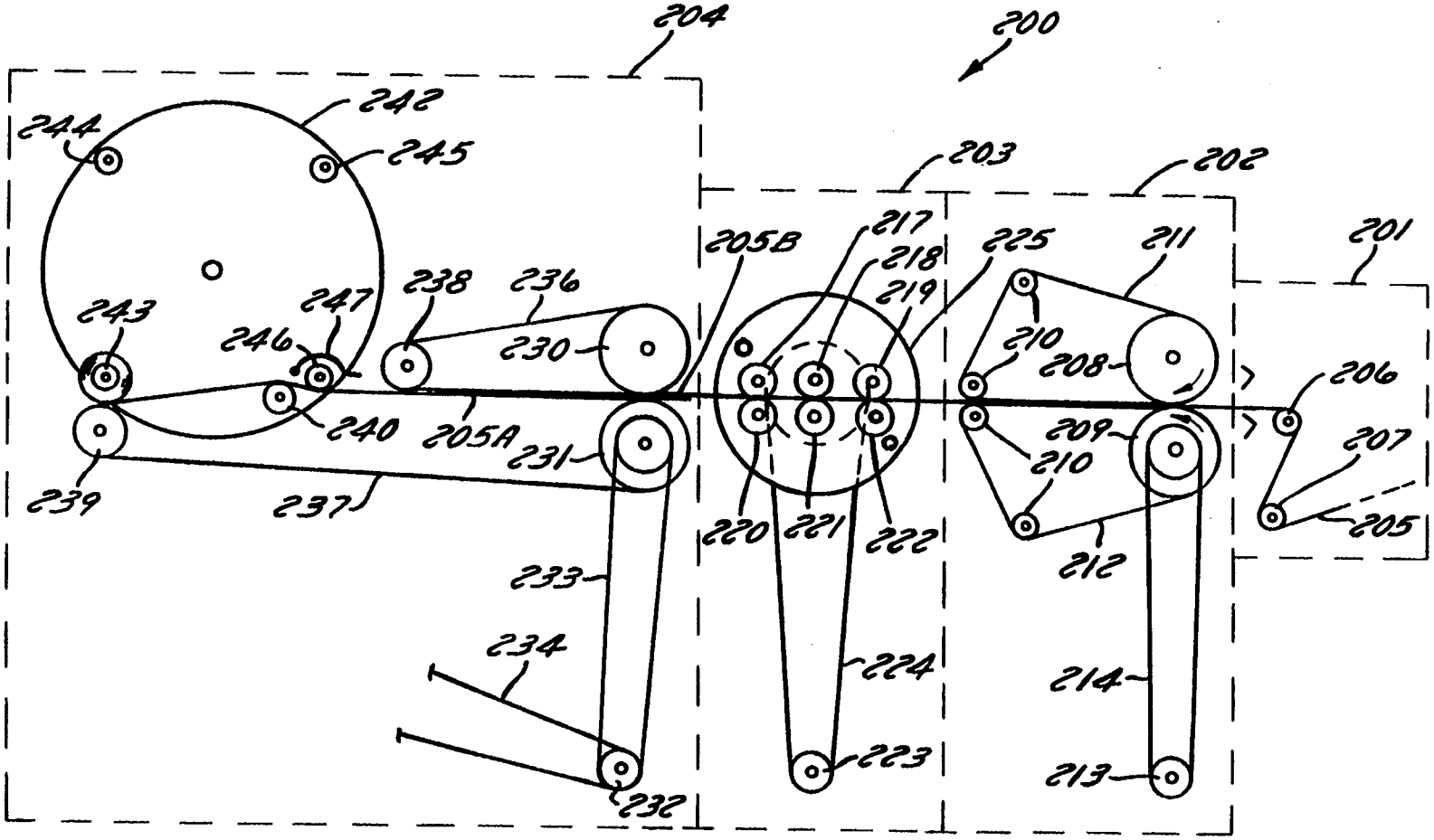
FIG. 5 is the schematic representation of the winder of FIG. 2 showing two interleaved bags in the tumbler assembly.

As shown in FIG. 4, the leading edge of succeeding bag 205B enters tumbler assembly 203 and the trailing edge of bag 205A is stored in tumbler 225 below the path line of bag 205B. Bag 205B will lie over bag 205A to facilitate winding the leading bag of each roll about the spindle in the position of spindle 246. As shown in FIG. 5 the overlap portion moves past conveyor rolls 230 and 231. The amount of overlap is determined by the length of leading bag 205A which has not yet entered winding assembly 204 when succeeding bag 205B is received by conveyor rolls 230 and 231. The interleaved film is then wound by winding assembly 204 as it was in the continuous mode. Of course, as stated above, because of the interleaving winding assembly 204 will operate at a slower speed than haul-in assembly 202.

Tumbler 225 rotates in this fashion for each bag, first enough rotation to separate the bags, and then rotation to take up the slack created by the slower moving turret assembly rolls. The amount of overlap desired between bags determines the ratio of the speed of the haul-in assembly 202 to the winding assembly 204. Similarly, bag length also determines when the tumbler 225 rotates, since it must do so in order to tear the perforation between bags. In the preferred embodiment (for bags about 72 inches long) tumbler 225 is in position to take up slack (the position shown in FIG. 3) when the leading edge of the bag is about one inch into the nip between conveyor rolls 230 and 231. Of course, the invention is not limited to bags of a particular length nor to a particular amount of overlap.

Using a servo motor drive system is advantageous for several reasons. First, the speed of the rolls may be readily adjustable according to a predetermined microprocessor program so that the user may easily select between modes of operation and the amount of overlap. Second, the microprocessor servo control allows this adjustment to be done "on the fly," i.e. without stopping the system. Third, the control can be more precise. And, fourth, the tumbler assembly 203 which takes up the slack, can be made to be more precisely responsive to control to take up the slack created by the difference in speed between the haul-in assembly 202 and the winding assembly 204.

In this mode the bags must still be counted, to determine when air horn 247 should be activated and when turret 242 should rotate. Moreover, it is also important to determine when each perforation will be in the position to be torn. This can be performed by a spark gap counter or other counters located a predetermined distance upstream from tumbler assembly 203, such as near dancer assembly 201.

Also, whether the winder 200 is used for interleaved or continuous rolls, winding assembly 204 may selectively provide for core or coreless rolls using well-known techniques. Thus, it is possible, with a single winder 200, to wind either interleaved or continuous rolls, and core or coreless rolls.

In accordance with the method of the present invention film 205 is received by haul-in assembly 202. Haul-in assembly 202 drives the film at a predetermined speed. The roll is wound by winding assembly 204, which operates at a line speed slower than that of haul-in assembly 202, to account for the interleaving of the bags. The slack created by the difference in speed is taken up by tumbler assembly 203, which lengthens the path that the tail end of each bag must follow. The path is lengthened as tumbler 225 turns. To tear adjacent bags along an already existing perforation, tumbler 225 quickly turns, at a speed sufficient to increase the path length at a greater speed than the difference between the speed of winding assembly 204 and haul-in assembly 202.

Generally speaking, in the overlap mode, tumbler 225 temporarily stores the slack created by the slower moving winding assembly 204. For a given bag length and desired overlap the length of slack needed to be stored is constant. Also, for a given diameter tumbler the length of slack stored is dependent on the angular rotation of the tumbler. In accordance with one embodiment of the present invention the rotation of tumbler 225 necessary to create an overlap length D for a bag of length L may be determined as follows.

To create an overlap length D, a length (L−D) of web 205 must leave tumbler 225 in the same time that it takes a web length L to enter tumbler 225. Thus, the ratio of the outgoing web speed to the incoming speed is (L−D)/L.

The length of slack (S) of web 205 needed to be taken up over any time interval is equal to the difference between the length of web 205 entering tumbler 225 (DI) and the length of web 225 leaving tumbler 205 (DS). Because these lengths are proportional to the velocities the outgoing length DS is equal to the incoming length DI multiplied by (L−D)/L. Thus, the slack equals the incoming length multiplied by (1−(L−D)/L). In summary, $$\begin{aligned} S &= DI - DS \\ &= DI - (DI * (L-D)/L) \\ &= DI * (1 - (L-D)/L) \end{aligned}$$

Figure 7:
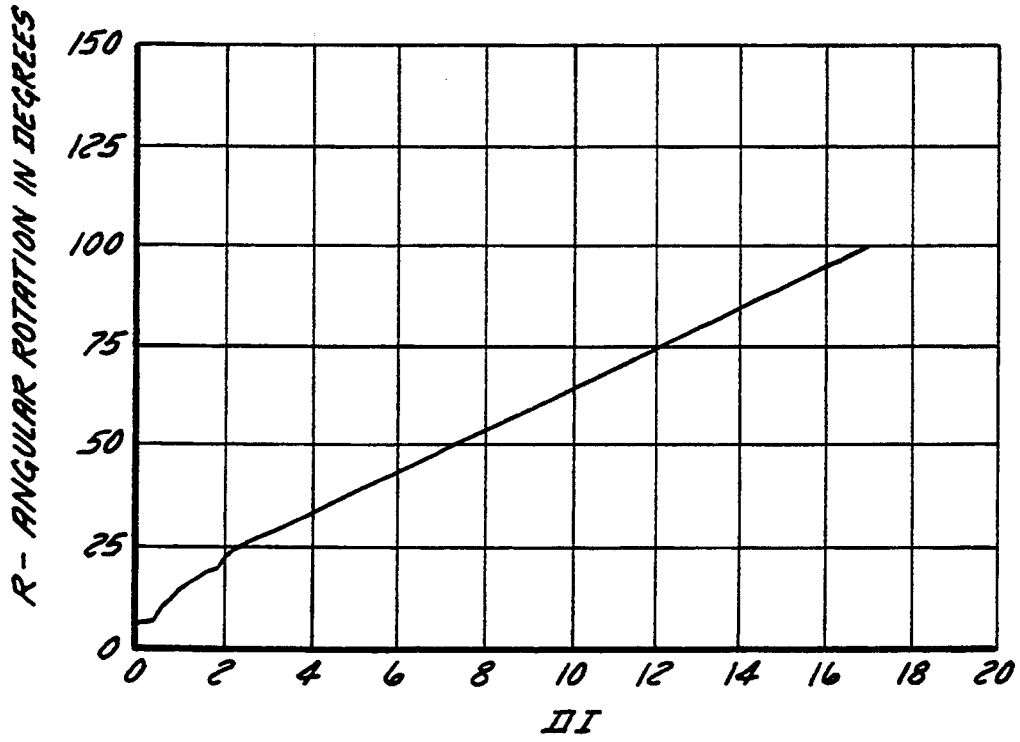
FIG. 7 is a graph showing the relationship between angular rotation and incoming length.

This describes the general relationship between slack generated and infeed length. To determine the angular rotation of tumbler 225 needed to take up a length of slack S, empirical data may be collected (i.e rotate tumbler 225 a few degrees at a time and measure the slack taken up for each incremental rotation). From the empirical data and the relationship between S and DI an empirical relationship between angular rotation R and slack S may be determined (for every few degrees of rotation). The data may be interpolated to obtain the relationship of R and S at angles other than those measured. Data for a typical tumbler utilized by CMD Corp., the assignee of the present invention, is shown in FIG. 7, where the horizontal axis is DI in inches and the vertical axis is angular rotation in degrees. This empirical curve will change for any change in bag length L, overlap D or tumbler diameter, but will remain constant otherwise.

The leading edge of bag 205A should be held firmly in the nip formed by conveyor rolls 230 and 231 when the rotor starts to take up slack. To assure this, tumbler 225 does not rotate until about one inch of the leading edge passes through the nip formed by conveyor rolls 230 and 231. Thereafter tumbler 225 must be rotated faster than required by the R−S relationship to "catch up" to the slack created.

This may be advantageous because the empirical R−S relationship is very nonlinear over the first part of tumbler 225's rotation. Preferably the slack taken up by tumbler 225 catches up to the slack created at the approximate angle where the empirical R−S relationship shown in FIG. 7 becomes a straight line. This is estimated to be at the point where the infeed displacement is 1.75×L/D, which is about 23 degrees for the data of FIG. 7.

From this angle forward until the perforation must be torn, tumbler 225 rotates just enough to take up the slack created and thus the angular rotation may be simply calculated from the slope of the R−S curve. For the data of FIG. 7 this is about 5.00 degrees per inch of slack.

When the perforation at the tail of the bag must be broken, tumbler 225 must accelerate and will no longer follow the R−S curve. This can occur any time after the tail perforation reaches the nip between rolls 219 and 222, provided the leading edge of bag 205A is caught in the nip formed by rolls 230 and 231.

In one embodiment the length of bag 205A that passes through tumbler 225, from the time the trailing edge perforation is broken, is divided into three portions and the remaining rotation of tumbler 225 to complete a 180 degree cycle is divided into 4 portions. Tumbler 225 is moved 2/4 of the remaining way as bag 205A moves the first ⅓ of its remaining way. Tumbler 225 moves the last 2/4 of the way as the infeed moves the last ⅔ of the way. Thus, the cycle is complete.

Tumbler 225 maintains this motion profile relative to film 205 repetitively. As long as the bag length and overlap setting remain the same, the profile need not change. As a practical matter, the bag length may vary slightly. A "registration" function compensates by inserting frequent, regular, small corrections to the rotor position relative to the infeed position. If the bag length error compared to the average bag length calculated before the start of the overlap process changes too much, it is detected and overlap mode is shut off.

Numerous modifications may be made to the present invention which still fall within the intended scope hereof. For example, controls other than a servo motor control could be used. Also, a different number of rolls in the tumbler system could be used. Similarly, the separation between bags could be performed by interrupt rolls such as the ones used in the prior art to separate bags. Thus, it should be apparent that there has been provided in accordance with the present invention a method and apparatus for interleaving plastic bags that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. An apparatus for winding a roll of bags, each bag having a length L, a leading end and a trailing end from a film of bags comprising:
   - a dancer assembly;
   - a haul-in assembly, including at least one haul-in roll operating at a haul-in speed;
   - a tumbler assembly disposed to receive the film from said haul-in assembly, said tumbler assembly including a rotating tumbler means for separating adjacent bags and for increasing the length of the path the trailing end of each bag travels by at least a length S=DI * (1−(L−D)/L) where DI is an infeed bag length, and said tumbler assembly further includes means for interleaving the bags, whereby the leading end of a second bag is downstream of the trailing end of a first bag by a length D; and
   - a winding assembly disposed to receive the film from said tumbler assembly, wherein said winding assembly operates at a speed less than said haul-in speed.

2. The apparatus of claim 1 wherein said rotating means separates adjacent bags.

3. The apparatus of claim 1 wherein said dancer assembly includes means for providing a signal indicative of a difference between the speed of the film upstream from said dancer assembly and downstream from said dancer assembly, and wherein said winding assembly speed and said haul-in assembly speed are responsive to said signal.

4. The apparatus of claim 1 further including a servomotor operatively disposed to drive said rotating means.

5. The apparatus of claim 4 further including microprocessor means for controlling the length of overlap D.

6. The apparatus of claim 5 wherein said microprocessor means includes means for changing the length of overlap between said first and second bags while the apparatus is winding bags.

7. The apparatus of claim 1 wherein the strip passes through said haul-in assembly at a speed less than the speed at which said haul-in assembly operates.

8. A method for winding interleaved bags from a strip of bags, each bag having a length L and a leading and a trailing end, comprising the steps of:

driving the strip at a first speed in a first stage;

driving the strip at a second speed in a second stage, said second stage being downstream of said first stage, wherein said second speed is less than said first speed;

increasing the path length by at least a length S that the trailing end of each bag follows between the first and second stages;

interleaving said bags when said path length is increased, whereby the trailing end of a first bag overlaps the leading end of a second bag by a length D, where $S=DI*(1-(L-D)/L)$ and DI is an infeed bag length.

9. The method apparatus of claim 8 wherein said step of increasing the path length includes the step of separating adjacent bags.

10. The method of claim 9 further including the steps of:

providing a signal indicative of a difference between the speed of the strip upstream from said first stage and in said first stage; and adjusting the speed of said first and second stages in response to said signal.

11. The method of claim 10 further including the step of controlling when the path length is increased, relative to the position of the trailing end of the bag, in response to said signal.

12. The method of claim 10 further including the step of adjusting the rate of said path length increase in response to said signal.

13. The method of claim 11 wherein the step of increasing the path length includes the step of increasing the path length in increments.

14. The method of claim 8 further including the step of changing the amount of overlap between said first and second bags.

15. The method of claim 8 wherein the step of interleaving said bags includes the step of placing the leading end of a second bag over the trailing end of a first bag.

16. The method of claim 8 wherein the step of increasing the path length includes the step of rotating a tumbler assembly.

17. The method of claim 8 further comprising the step of separating adjacent bags by mechanically increasing the path length of the trailing edge of each bag.

* * * * *